US007909327B1

(12) United States Patent
Elliott

(10) Patent No.: US 7,909,327 B1
(45) Date of Patent: Mar. 22, 2011

(54) POKER GAME

(76) Inventor: Michael Elliott, Seattle, WA (US)

( * ) Notice: Subject to any disclaimer, the term of this patent is extended or adjusted under 35 U.S.C. 154(b) by 608 days.

(21) Appl. No.: 11/426,305

(22) Filed: Jun. 24, 2006

(51) Int. Cl.
*A63F 1/00* (2006.01)

(52) U.S. Cl. ..... 273/292; 273/274; 273/309; 463/13

(58) Field of Classification Search ..... 273/292, 273/303–308, 274, 309; 463/13, 12
See application file for complete search history.

(56) References Cited

U.S. PATENT DOCUMENTS 4,836,553 A 6/1989 Suttle et al.
5,288,081 A 2/1994 Breeding
6,206,374 B1 3/2001 Jones
6,322,077 B1 * 11/2001 Braunlich et al. ..... 273/292
6,598,880 B2 * 7/2003 Addabbo ..... 273/306
6,626,433 B2 9/2003 Scibetta
6,769,693 B2 8/2004 Huard et al.
6,854,732 B2 2/2005 Moody
6,893,049 B1 5/2005 Schmitt
6,896,265 B1 5/2005 Schlumbrecht
6,959,928 B2 11/2005 Schultz

* cited by examiner

*Primary Examiner* — Benjamin H Layno
(74) *Attorney, Agent, or Firm* — Jellett IP Law PS

(57) ABSTRACT

A system and method for playing a poker game. The system is implemented either through a software application or through a physical game environment. The system integrates a card elimination table which has a range of attack elements and range of removable elements. The attack elements are correlated to the removable elements so that when an attack card element is played, the removable elements correlated to that particular attack card element are eliminated from the game.

53 Claims, 12 Drawing Sheets

POKER GAME

BACKGROUND a) Field of the Embodiments

This concept generally relates to card games and methods for playing card games, and more particularly to poker style card games.

b) Background Art

A brief description of the background art including standard play for a Texas Hold'em Poker Game will now be provided. A standard Texas Hold'em Poker Game will be played according to the following general rules or guidelines:

Before cards are even dealt in a game of Texas Hold'em, it is important to have some initial money on the table. Two ways to start the initial money on the table is to provide either antes or blinds. An ante is a set amount put in the pot by every player in the game prior to the cards being dealt. This amount does not count toward the bet on the first round of betting. Blinds, however, do count towards betting but will be described further below. The simple method of using antes is provided generally in home games. It is not very common to use antes with Texas Hold'em specifically, antes are more often found in games like five-card stud or draw. Antes can be used in conjunction with blinds in later stages of say for example a tournament.

The second way to get money on the table is through the use of blinds. Based on the limit of the game, the player to the left of the dealer and the second player to the left of the dealer are both required to put up mandatory bets before the cards are dealt. These blind placements count toward the total investment in the first round of betting. For example, if the pot is not raised in a pre-flop position, the small blind which is the blind or bet placed by the first player to the left of the dealer, will only have to put in another one-half of a bet to call. Likewise the big blind, or the bet placed by the player in second position from the left of the dealer, won't have to put any more money into the pot although the big blind will have the availability to raise his own blind. In an unraised pre-flop pot, this is referred to as the 'option'.

Of course the amount that is put out by the blinds depends on the limit. In fixed limit poker, the big blind puts up a bet equal to the small limits. The small blind puts up half that amount. So if the limit is $5/$10, the big blind is $5.00 and the small blind is $2.50. This is unlike a no-limit or pot limit poker game. In a $5/$10 no-limit Hold'em Game, the small blind would be $5.00 and the big blind would be $10.00.

Still briefly discussing blinds and antes as they occur in tournaments, the way that Texas Hold'em tournaments are structured, the blind and/or antes go up after a set period of time, called the 'escalation'. Each group of time for the blinds/antes stay the same is called a 'level'. Usually when players go up a level, the blinds double or are less than double. If the antes are introduced, they usually do not double every level. To sometimes start a tournament, the big and small blinds are the same amount at the next level of the big doubles.

After the blinds or antes are submitted, the dealer shuffles up to a standard deck of 52 playing cards. If a House is providing the dealer, a deeper deck may be provided up to say for example six decks which have been preshuffled.

Each player is dealt two cards face down. These are called the hole or pocket cards. There is then a round of betting starting with the player to the left of the first two posted blinds players. This round is usually referred to as the pre-flop round.

The amount a player can bet depends on what kind of game is being played. During a betting round, similar to most games of poker, players can check, raise, or fold. After the betting round ends, the dealer discards the top card of the deck. This is called a burn card which is done to prevent cheating and the like.

The dealer then flips the next three cards face up on the table. These common cards are called the 'flop'. The cards can be used by any player in combination with the two pocket cards to form a poker hand. After the 'flop' has occurred, there is another round of betting starting with the player to the left of the dealer. After the round of betting concludes, the dealer burns one more card and flips another card onto the table. This card is called the 'turn card'. Players can use this sixth card to now form a five-card poker hand.

Again, the player to the left of the dealer begins another round of betting. Finally, the dealer burns a card and places a final card face up on the table. This final card is called the 'river'. The players can now use any of the five cards on the table or the two cards in their pocket to form a five-card poker hand.

There is one final round of betting after the 'river' card has been placed which is again started with the player to the left of the dealer. After this final round of betting, all players remaining in the game begin to reveal their hands which resolves the bets. This reveal begins with the player to the left of the last player to call. This resolving of the bets is called the 'showdown'. Players use a combination of their pocket cards and the community cards to form a poker hand. The player who shows the best hand wins. In some cases players with equal hands share the winnings. In this case the pot is split between the two winners.

A brief discussion of additional prior art poker games will now be provided.

U.S. Pat. No. 4,836,553 discloses a poker game. In the background of the invention section beginning in col. 2 at line 67, "it is an object of the present invention to provide a game of chance in which each player plays his poker hand against a poker hand held by the House or a banker and in which a player receives a bonus payment based on the type of poker hand that a player holds." Further in the brief summary of the invention section, in col. 2 at line 13, "a modification of a conventional five card stud poker game particularly adapted for casino play is provided in which a dealer plays against each of a plurality of players. In the preferred method of play, each player places an ante in a designated location; the dealer deals five cards to each player and himself. All cards are dealt face down except the dealers. Each player views his hand and decides to continue by making an additional bet or twofold or drop, in which case he loses his ante. The dealer then reveals his entire hand; if the dealer's hand does not have a poker value of at least ace/king, then the dealer is not permitted to continue play. If this is the case, the dealer pays even money on the remaining player's antes, and returns their best to them. If the dealer's hand has poker value of ace/king or better, the dealer compares his hand to each player, paying or collecting the bets as appropriate."

U.S. Pat. No. 5,288,081 discloses a method of playing a wagering game. According to the summary of the invention in col. 2 around line 1, the present invention is played with a single typical 52 card poker deck and broadly involves the generally well-recognized and accepted set of rules of five card poker". Referring to line 7, "the game method comprises each player placing an initial three-part wager to participate in the game. Cards are dealt by a dealer, 3 down to each player and 2 down to the dealer. Players inspect their cards, and the dealer asks 'take it or leave it or let it ride', with regard to the first part of the initial bet. Players can choose to retrieve or remove from play the first part of their initial bet, or leave the first part in play or at risk, based on the value of the 3 cards in hand. The dealer turns over one of the dealer cards and the query is repeated. Players choose to retrieve or remove from play the second part of their initial bet or leave in play at risk, based on the value of the 4 cards consisting of the 3 cards in the players hand and the exposed dealer card. Players have no option with the third part of the bet. Lastly, all cards are shown and payouts and collections are resolved according to the ranking of the poker hands of each player."

U.S. Pat. No. 6,206,374 discloses methods of playing poker games, referring to the summary of the invention as seen in column 2 at line 17, "the present invention relates to methods for playing seven card stud and five card draw poker variants including an optional progressive jackpot feature, and more particularly relates to particular variations of the Caribbean stud registered trademark poker variant disclosed in U.S. Pat. No. 4,836,553 and including an optional progressive jackpot component as discussed in U.S. Pat. No. 4,861,041 and U.S. Pat. No. 5,078,405."

U.S. Pat. No. 6,626,433 discloses a card game. In the summary of the invention section, at col. 3 line 1, "the card game of the present invention is played by a player first placing a bet, preferably in a betting spot using chips. Next, the dealer deals a predetermined number of cards to each player face down onto an area on the table called a 'pot' designated for the player and afterwards deals the same preset designated number of cards to another area on the table called the 'dealer's pot' in a location of the table designated for the dealer's pot. One play in a series includes the dealer turning up a player's top card and turning up the dealer's top card: high wins at even odds of 1 to 1; equal cards are a draw or 'push' and neither wins except if a player has a deuce in which case the player's deuce loses 1 to 1 odds; a player's ace wins at odds of 3 to 2. After one play, a player may place a new bet before cards are next turned over." Referring to col. 4 around line 13, "an advantage of the card game of the present invention over prior art card games is that it is substantially less complex, thereby enabling the game to move quickly which decreases the associated operational overhead."Further down col. 4 at line 22, "a still further advantage of the present invention is the simplicity of betting wherein a winning bet is easily recognized."

U.S. Pat. No. 6,893,049 discloses crazy stud poker. In the summary of the invention section in col. 1 at line 22, "the present invention provides an improved means of playing stud poker using wild-card variations with an all 4 ace suites, all for 7 suites, all for 2 suites and both red and black jokers. The present card game invention has 54 cards therein. There are 14 cards used in the present invention to create the wild-card variations within the card game of crazy stud poker."

U.S. Pat. No. 6,896,265 discloses casino flop poker. In the background section in col. 3 at line 25, "it is an object of the present invention to provide a casino variation of five card stud which allows players to bet against the House hand and each other while quickly revealing results of each game." In the brief summary, in col. 3 at line 66, "the method includes one or more players making wagers against the House and against other players. Players are given the opportunity to increase their initial wager against the House. The player's hand is a designated winning outcome, the player receives a payoff based upon his wagers against the House and if the outcome is a losing outcome, the player's wagers against the House are lost. At the same time the player's hand is compared against all other hands in the game and the best hand wins all wagers against the other players. In flop poker the object of the game is 2-fold: a) to make a good poker hand and b) to win various bets."

U.S. Pat. No. 6,959,928 discloses a poker type card game method. According to the summary of the invention in col. 5 beginning at line 51, "the basic game is showdown poker between at least one player's hand and a dealer's hand. Early in the game this new method always gives the dealer's hand preferred treatment; consequently, a dealer's initial/partial hand is always more valuable than the player's initial/partial hand. Later in the game, the dealer's advantage is partially or totally offset by a second specific game action that always favors the player's hand. This second action gives the player's hand the reasonable opportunity to beat the dealer's hand in a showdown. These two actions provide reciprocal advantages initially only to the dealer, then finally only to the player."

In addition to the above prior art patents, there are number of poker games which focus on community cards players can combine with personal cards to form a five card hand. The following are variants of the popular Texas hold'em poker game as seen on the following web site http://www.texasholdem-poker.com/variants.php, they include:

"Pineapple"—Instead of two cards, each player is dealt three cards and immediately discards one of those three pocket cards face-down before pre-flop betting begins. This game is best played straight with no high/low option. Limit or no limit is preferable to pot limit.

"Crazy Pineapple"—Instead of two cards, each player is dealt three cards. Before the turn card is dealt (after the post-flop betting), each player discards one of those three pocket cards face-down. If a player does not discard a card, his or her hand is dead after the turn is dealt. This game is best played high/low, 8 or better. Limit and pot limit are common, with no limit being fairly rare.

"Double Flop Hold'em"—Whenever communal cards are dealt there are two different boards dealt. Players can use their two cards in combination with either of these two separate boards, one OR the other. So if you had JT and with boards of AJ533 and Q9855, you would have two pair, jacks and threes, ace kicker on the top board and a queen-high straight on the other. So your hand is a queen-high straight. You could NOT make a hand like a full house, fives full of jacks using both boards. This game is best straight without a high/low option with structured limits or no limit. Optionally it can be a split pot game where the winner of each of the two boards gets half the pot, which is often played pot limit.

"Super Hold'em"—Players are dealt three hole cards. Players may use all 3 in combination with 5 board cards to form a five card poker hand. Like Hold'em plus a card.

"Tahoe Poker"—Players are dealt three hole cards. Players must use exactly 2 of their hole cards in combination with 5 board cards to form a five card poker hand. Like Omaha minus a card.

"Omaha"—Players are dealt four cards instead of two. Players must use exactly two of their hole cards in combination with three of the five board cards to make a five card hand. Omaha is often played high/low, either fixed limit or pot limit.

"Chowaha"—Players get two hole cards but there are three flops (all dealt at the same time), two turns (dealt at once), and one river. Players form combinations of boards using their hole cards and specific board lines, of which there are four. The top flop can't be used with the bottom turn and the bottom flop can't be used with the top turn. Often this is played Eight or Better and different board lines can be used to make a high or a low hand.

"Blind Man's Bluff"—When each player is dealt their two pocket cards, they do not look at them. Instead they hold them against their forehead so that every other player can see them. If you look at your cards before the showdown, your hand is ruled dead.

DESCRIPTION OF THE PREFERRED EMBODIMENTS

The present system can be implemented either by using a physical poker game environment such as a poker table, chairs, a deck of cards, players, and various rules which the players are exposed to during and prior to the game play, and also the system can be implemented through a software game application which generally will utilize in some form game database, client computer, game application, various game objects, and may even be implemented or hosted on a server which can be implemented to host the application for access by authorized clients. Furthermore, additional variants of the current system can include implementation in formats which mix the physical poker game environment with the software application game.

In describing the embodiments, discussion of the method of the present embodiment combative poker game play will be provided, followed by discussion of the implementation of the method on various systems.

Figure 1:
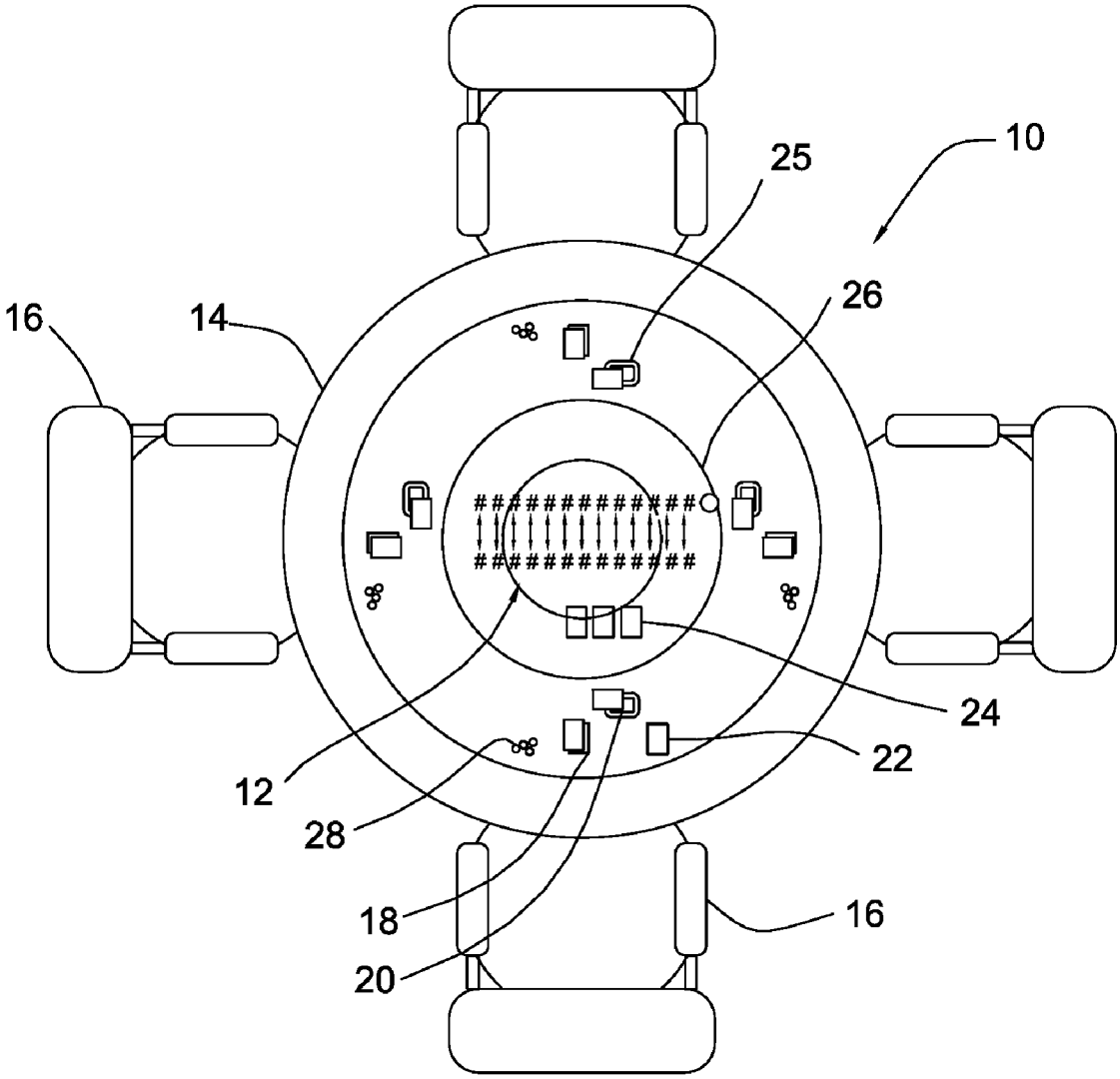
FIG. 1 is a plan view of the combat poker game.

A brief discussion of the present method will be provided followed by a more detailed discussion of the method. To implement the combative poker game 10 (as seen in FIG. 1), three cards are dealt to each player. A betting round occurs. Three common cards are then dealt into the center of the table. Another betting round occurs. Players then choose cards which will act as attack cards. Players after choosing these cards reveal the attack cards. If any of the common cards are attacked and eliminated, they are removed from the common card pool. Another round of betting occurs. Players show their hands and determine the winner.

Figure 3:
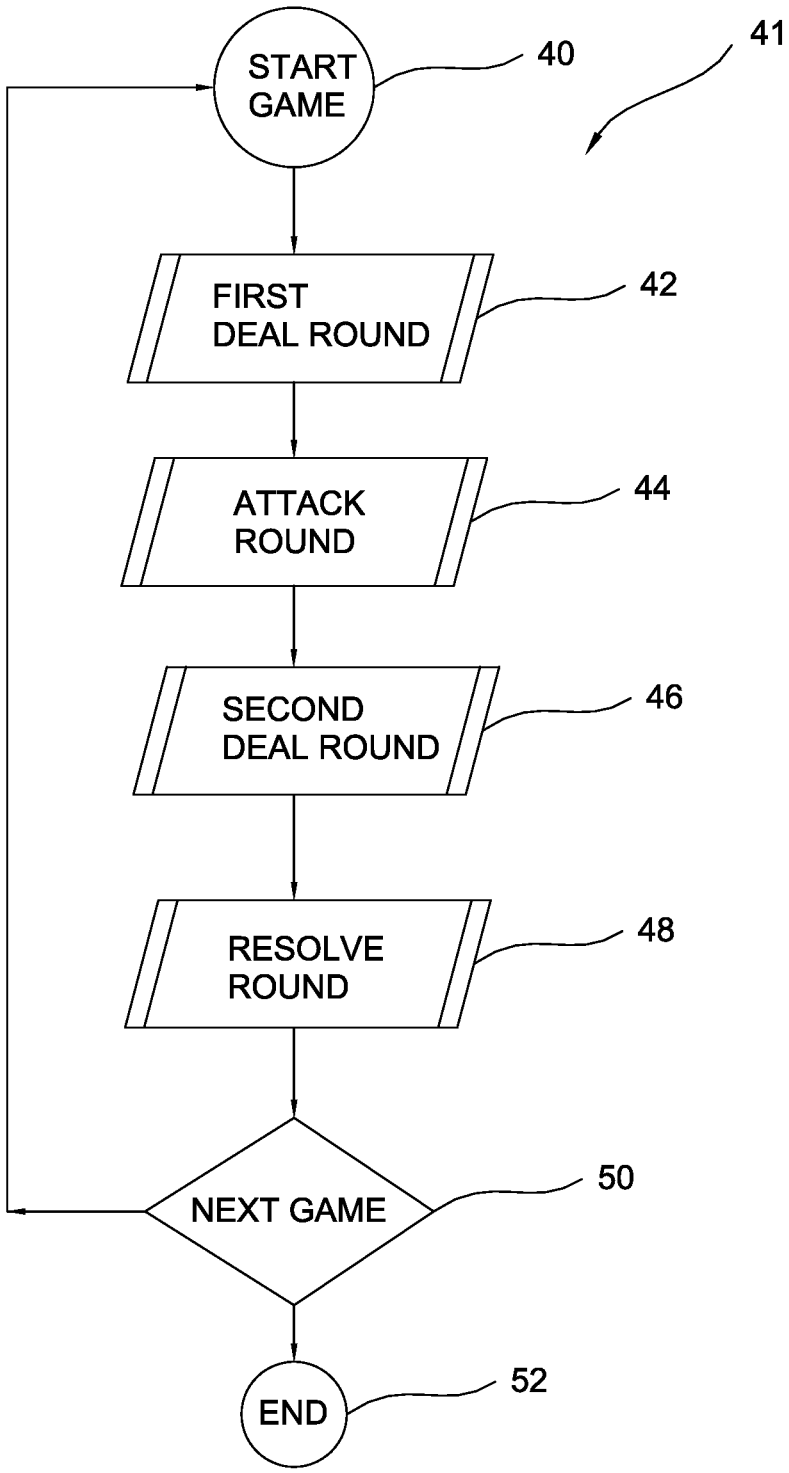
FIG. 3 is an over all schematic flow diagram of the combative poker game.

Referring to FIG. 3, a combative poker method 41 is shown embodying those previously-mentioned steps. The method includes starting the game at step 40 and performing a first deal round at step 42. After the first deal round 42 is complete, an attack phase or attack round 44 is implemented. Once the attack round 44 is complete, a second deal round 46 occurs. After the second deal round 46 has completed, a final resolve round 48 takes place. Here the players reveal their hands and make the best hand possible to determine a winner of the pot.

During the start game step 40, the players may wish to ante up, set blinds, or make forced bets. In one sequence embodiment, the first player to the left of the dealer makes a forced bet. The next player makes a forced raise. After this initial bet and raise, the beginning or start game step 40 is generally complete and the first deal around 42 occurs.

Figure 4:
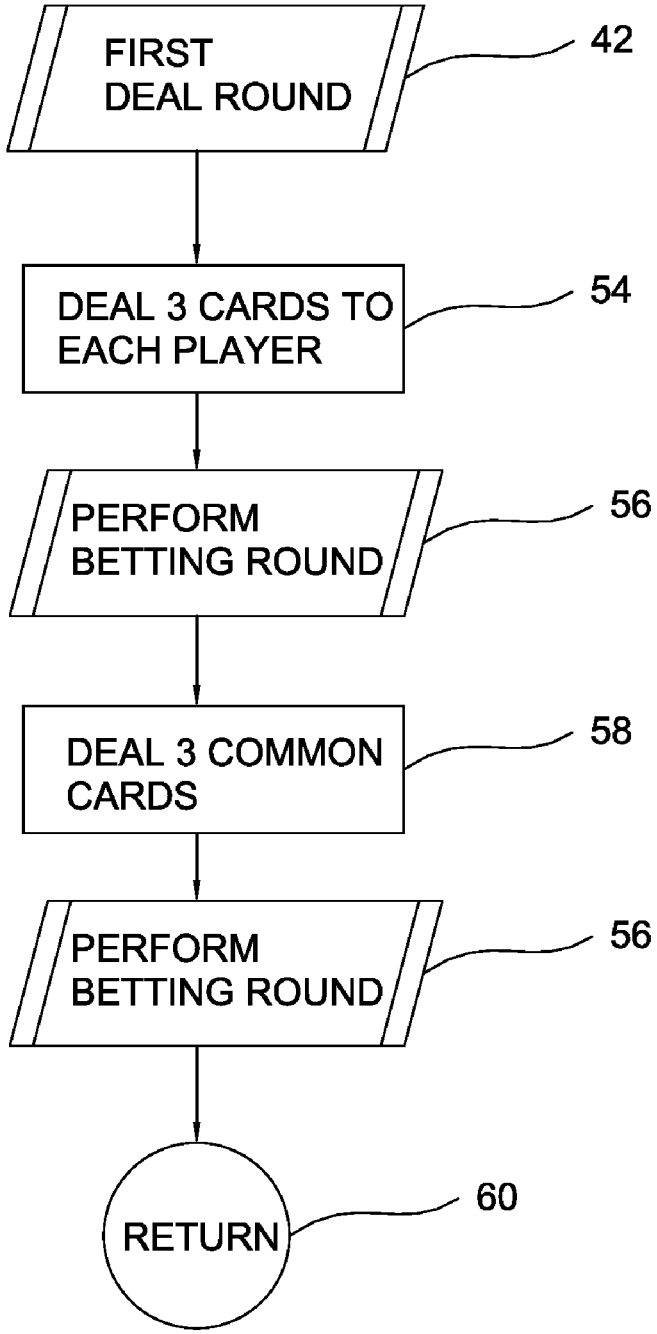
FIG. 4 is a flow chart of the first deal round.

Referring to FIG. 4, one embodiment of the first deal round includes after entering or initializing the first deal round at step 42 dealing three cards to each player step 54. It should be noted that the cards (as will be discussed further below) include card components as initialized in a game software application from game objects, or physical playing cards from a standard 52 card deck. After the three cards are dealt to each player at step 54, a betting round is performed at step 56. During the betting round, and similar to most games of poker, players can check, raise, or fold. In an alternative embodiment, after each betting round occurs, the dealer can discard the top card of the deck or burn a top card to prevent cheating.

After this performed betting round at step 56 occurs, the dealer deals three common cards at step 58. Another betting round is performed at step 56 again, players checking, raising, or folding out of game. After the first deal round 42 is complete, the game moves into its second phase, the attack phase or attack round 44 (as seen back in FIG. 3).

Figure 5:
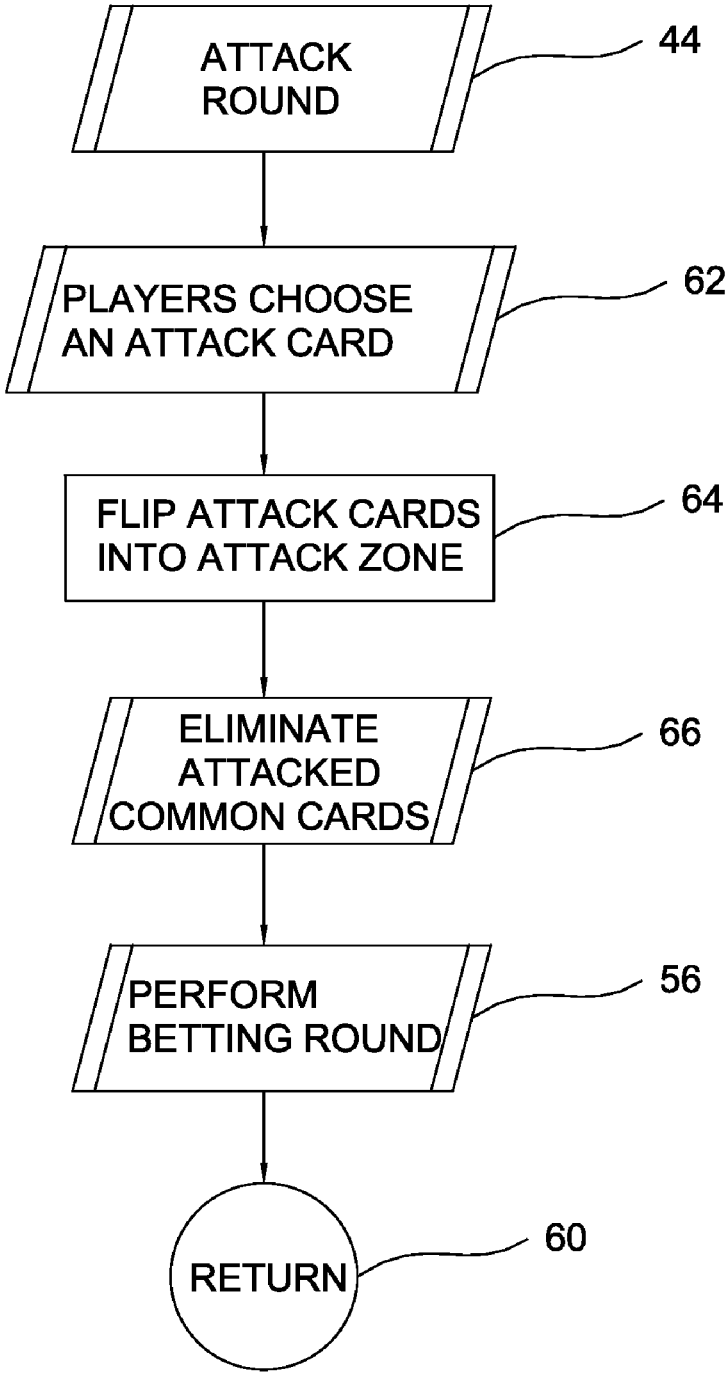
FIG. 5 is a flow chart of the attack round.

During the attack round 44 as initialized (as seen in FIG. 5), players can choose various cards to eliminate cards held by other players or eliminate cards which were exposed during the first deal round 42 in the common card deal 58 (FIG. 4).

Referring back to FIG. 5, one embodiment of the attack round 44 includes initializing the attack round 44 and players choosing an attack card 62 from the initial three cards dealt each player during the first deal round 42 (FIG. 4). The players flip attack cards into an attack zone at step 64. All decisions including betting and choosing attack cards are done in deal order, with the dealer selecting an attack card first and going clockwise around the table. Once each player remaining in the hand has selected an attack card, the attack cards are revealed and moved to the center and the common cards are eliminated at step 66 based on the revealed attack cards. Once the common cards have been eliminated, players perform another betting round 56 again, checking, raising, or folding out of the game.

Various options and alternative embodiments are derived from this attack round 44. For example, in lieu of activating an attack card, a player may choose to discard his chosen attack card in lieu of activating or flipping an attack card into the attack zone at step 64. A player may wish to discard rather than play the card as an attack card because doing so i.e. playing the card as an attack card, may wipe out their other cards in the player's hand. The throw or discard is revealed but does not count as an attack card. Thus the other players can see which card was the discard and make their educated assumptions based on that particular play. The discarded card is removed from the play area after it is viewed by all players in the game.

It should be noted that the attack cards in various embodiments of the attack round 44 will eliminate common cards but also eliminate player cards held by each player. In the present embodiment, the eliminated player held cards are not revealed until the final resolve round 48 (as seen in FIG. 3). Other variations can have the players discarding their eliminated held cards prior to the second deal round 46 (as seen in FIG. 3).

Figure 6:
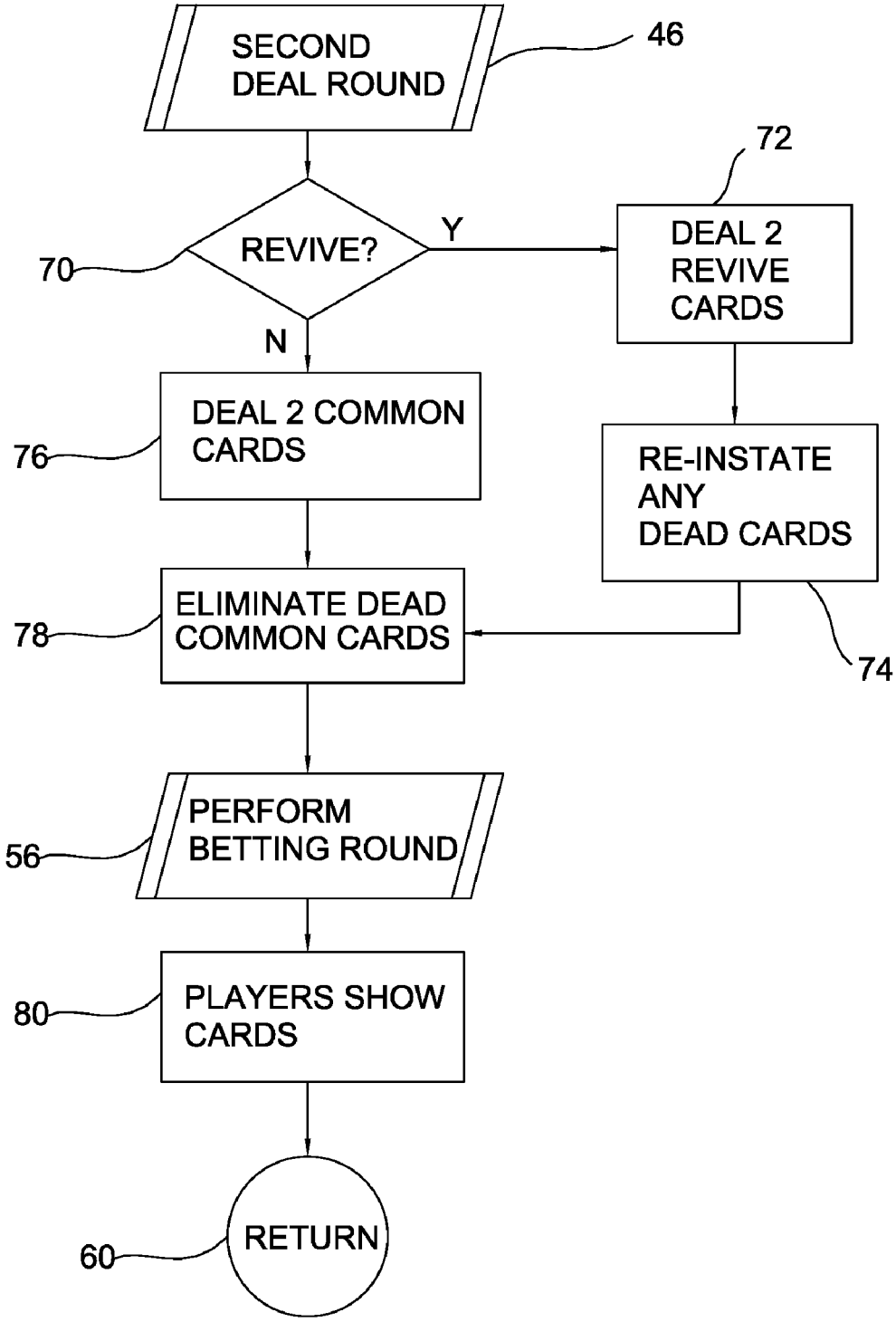
FIG. 6 is a flow chart of the second deal round.

After the attack round 44, a second deal round 46 occurs. In the present embodiment, (as seen in FIG. 6), the second deal round 46 is initialized and an optional revive round 70 may be played. If the revive round 70 is not played, the dealer deals two common cards at step 76. These two common cards are entered into the common pool as previously discussed and added to the deal three common cards pool 58 (as seen in FIG. 4). Because the attack round 44 has already been performed, the deal two common cards 76 may optionally be eliminated at an eliminate dead common cards step 78. Once this removal has occurred, another betting round is performed at step 56 followed by a resolve round at step 48 (as seen in FIG. 3). In the resolve round, the players reveal hands and make the best hand possible. Winner takes the pot and if players tie, the pot is split among the multiple winners.

Referring back to FIG. 6, if during the second deal round 46 a revive round 70 is begun, then the dealer will deal two revive cards at step 72. If these revive cards correlate to any of the eliminated dead common cards taken out by the attack round 44, then these dead cards will be reinstated at step 74. Regardless of whether the reinstatement occurs, the dead common cards are eliminated at step 78.

A combative correlation table or matrix is required so that the players are aware of the attack conditions and removal conditions during the game play. This combative correlation table or matrix can take various forms such as being resident on the poker table itself such as being imprinted on the felt of the poker table, or it can be resident in a database within the server or within the game application of the software. It may even take a simple form as an Excel spreadsheet which correlates different values of attack elements to different values of removal elements.

The number and type of card elements or playing cards will depend on the size of the deck. While a standard 52 card playing deck is utilized, other decks can be utilized having a greater number of cards or a lesser number of cards depending on the desired game play. For discussion purposes a standard 52 card deck will be utilized. As is commonly known, the deck will have four suits, a hearts suit, a diamonds suit, a spades suit, and a clubs suit. Each suit will have a two card, a three card, a four card, a five card, a six card, a seven card, an eight card, a nine card, a ten card, a Jack card, a Queen card, a King card, and an Ace card. Also each deck will have a Joker although it is not generally used in poker. The hearts suit and the diamonds suit are generally red although other colors can be used; the clubs suit and the spades suit are generally black.

Figure 2:
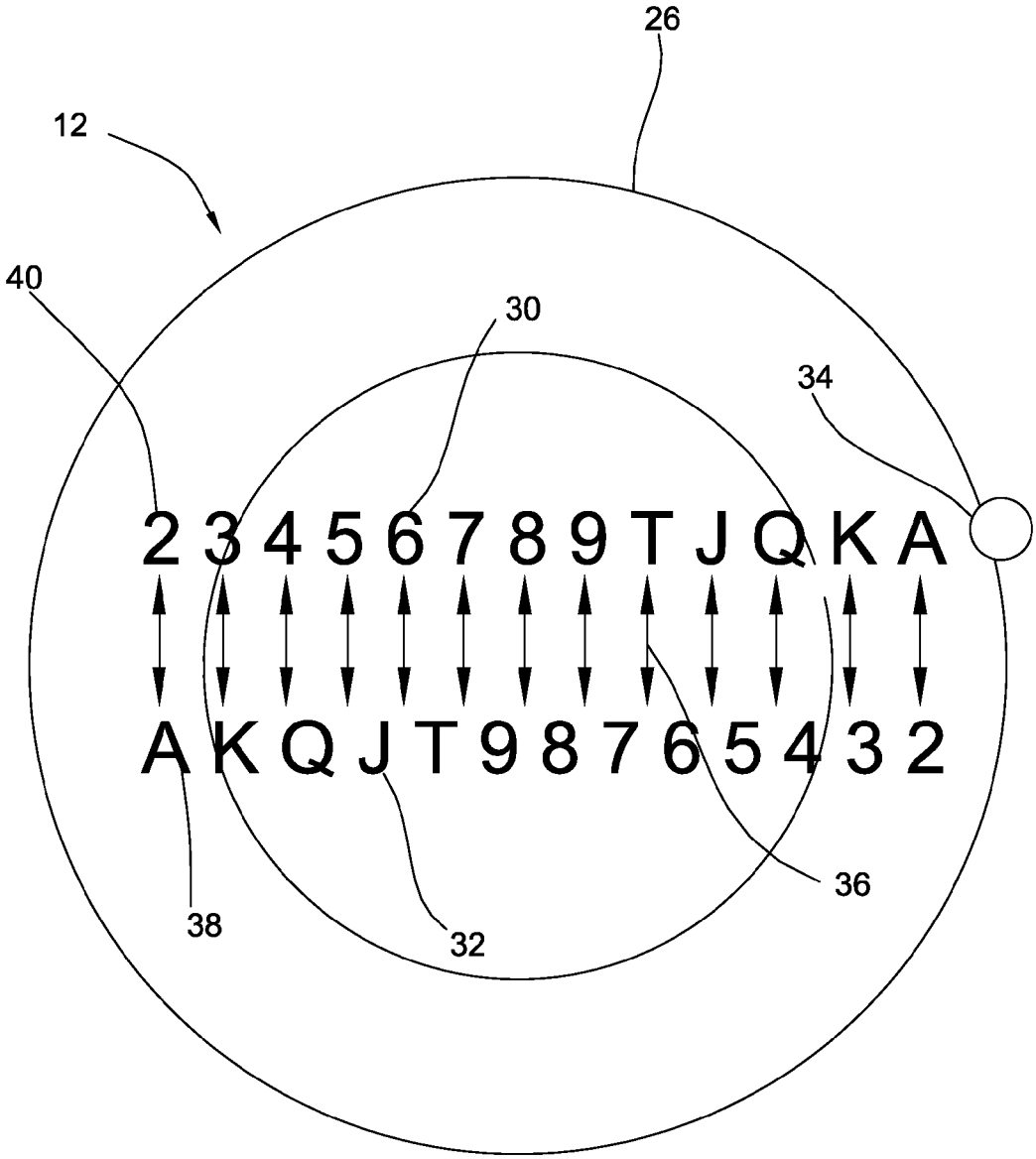
FIG. 2 is a detail plan view of the combat correlation table.

To determine which card elements in the players hand can be played as attack card elements, the combative correlation table matrix 12 (as seen in FIG. 2) will set up in this particular instance, a one-to-one elimination relation link 36 between the individual card element within the attack card element range 30 and the individual removable card elements within the removable card element range 32.

Figure 2A:
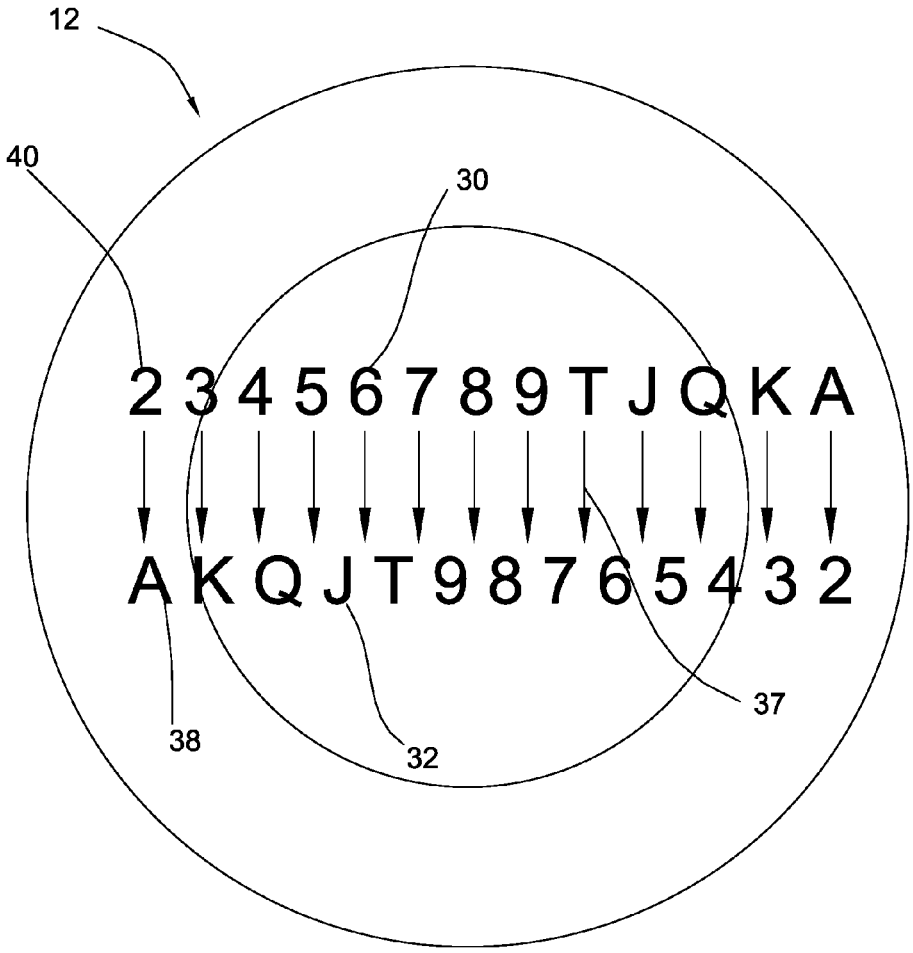
FIG. 2A is an alternative detail plan view of the combat correlation table.
Figure 2B:
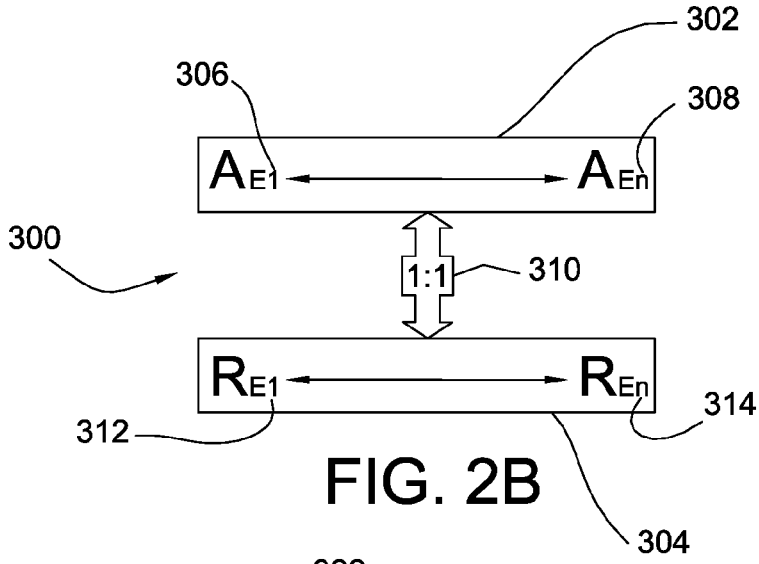
FIG. 2B is an alternative detail plan view of the combat correlation table.

Various combative correlation table matrix conditions can be implemented based on the conditions set up by the game user as will be discussed in FIGS. 2B through 2F. Referring first to FIG. 2B, a combative correlation table matrix having a one-to-one relation 300 is provided. Here the attack element range 302 has a first attack element 306 and runs to the last attack element 308 in the nth position. On the removable element side, the removable element range 304 has a first removable element 312 which correlates to the first attack element 306 through a one-to-one element relation 310. The intermediate follow on elements as well as the last removable element 314 in the nth position all relate on a one-to-one element relation to the elements in the attack element range 302.

This one-to-one element relation table matrix 300 can be utilized for example where a card attack element or playing attack card (as seen in FIG. 2) is a number two attack card element 40 having a 1:1 elimination relation to an Ace removable card element 38. A further refinement is where the attack card element range (as still seen in FIG. 2) only deals with suits that have a red color such as the hearts suit and the diamonds suit. Furthermore, the elimination relation direction linking components 36 can be controlled by a direction controller or puck 34 which indicates which range is the attack card element range 30. As seen in FIG. 2A, the elimination direction linking component 36 is preset in a single direction. Referring back to FIG. 2, by providing various indicia on the puck 34, the players or the dealer can indicate which range will be the attack card element range, as well as which suit may be employed for attack and removal, if any suit is so designated.

In addition to having the entire series of 13 cards playable as attack and removable elements in a one-to-one relation, an alternative embodiment includes using only a subset of cards to be playable as attack cards and/or as removable cards. For example, face cards, king queen and jack, may not be played as attack cards leaving only the numbered cards as attack cards and correlating them to numbered removable card elements.

While a direct one-to-one equal relationship may be provided based on an equal number of attack card elements correlating to an equal number of removable card elements, a scenario where a predetermined set of lesser attack card elements may eliminate a larger spectrum or range of removable card elements. Referring to FIG. 2E, such a combative correlation table matrix having an (i):(n) relation 340 where the (n) indication is the largest range spectrum and the (i) indication is a lesser range spectrum is shown. Here the attack element range 344 ranges from a first attack element 346 to a last attack element 348 in the nth position. The (i):(n) element relation 342 correlates to a larger removable element range 304. Here the first removable element 312 begins the removable element range 304 and ends in the last removable element 314 in the nth position. An example is as follows, where the attack element range 344 would include seven cards, and the removable element range 304 would include a full suit of 13 cards. By playing an attack element, the (i):(n) element relation 342 would indicate that more than one of the removable elements within the removable element range would be eliminated during the attack round 44 (as seen in FIG. 5) by a lesser number of attack elements.

Figure 2C:
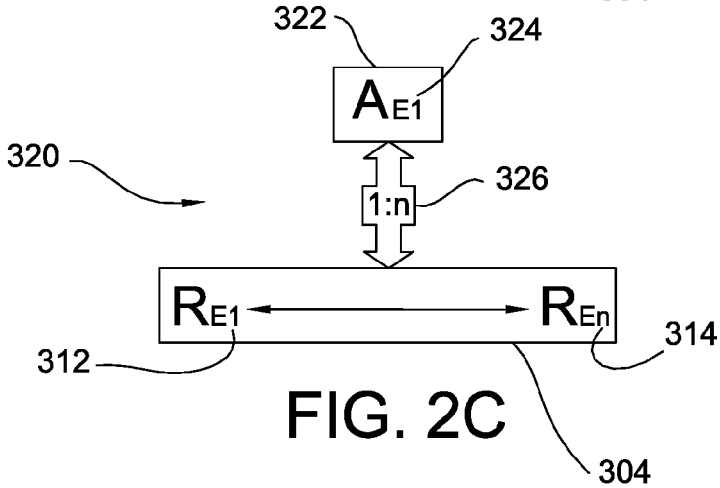
FIG. 2C is an alternative detail plan view of the combat correlation table.

At the end of this correlation table matrix where the removable element range 304 has the larger spectrum to the nth position, a combative correlation table matrix in a 1:(n) relation 320 is seen in FIG. 2C. Here a single element of attack range 322 has a first attack element 324 which will, when played, eliminate the removable elements shown in the removable element range 304 starting from the first removable element 312 to the last removable element 314 in the nth position.

A discussion of the removable element range having a lesser spectrum of elements than the attack element range will now be provided.

Figure 2D:
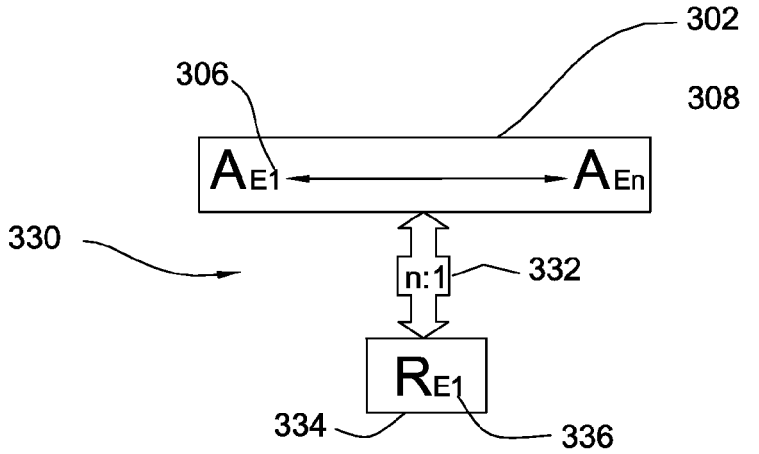
FIG. 2D is an alternative detail plan view of the combat correlation table.
Figure 2E:
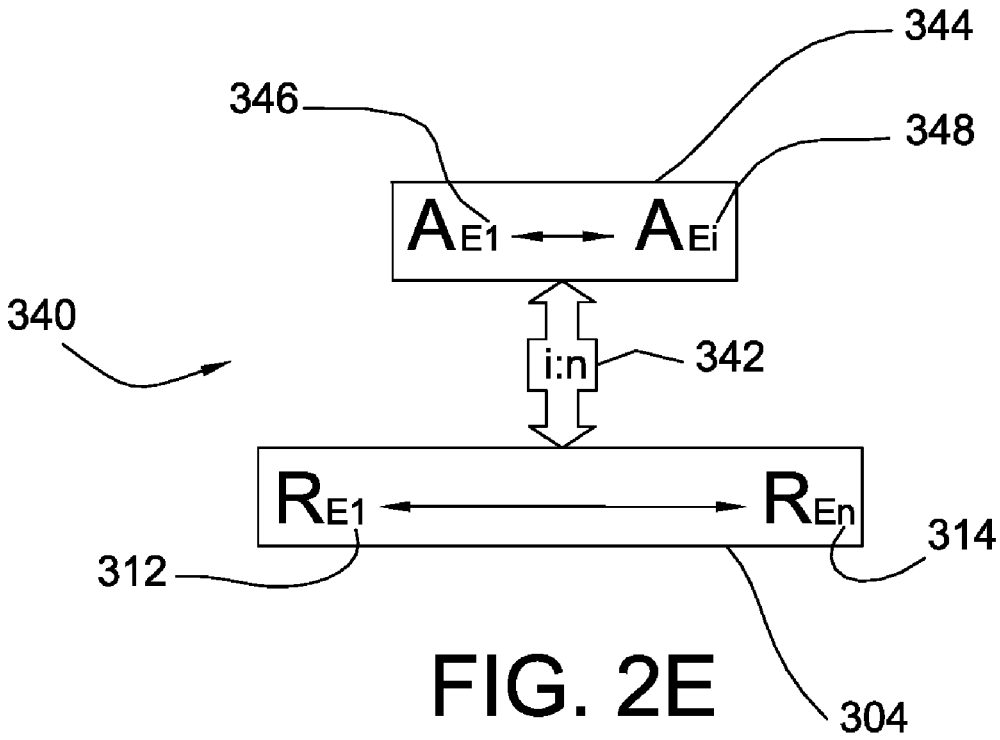
FIG. 2E is an alternative detail plan view of the combat correlation table.
Figure 2F:
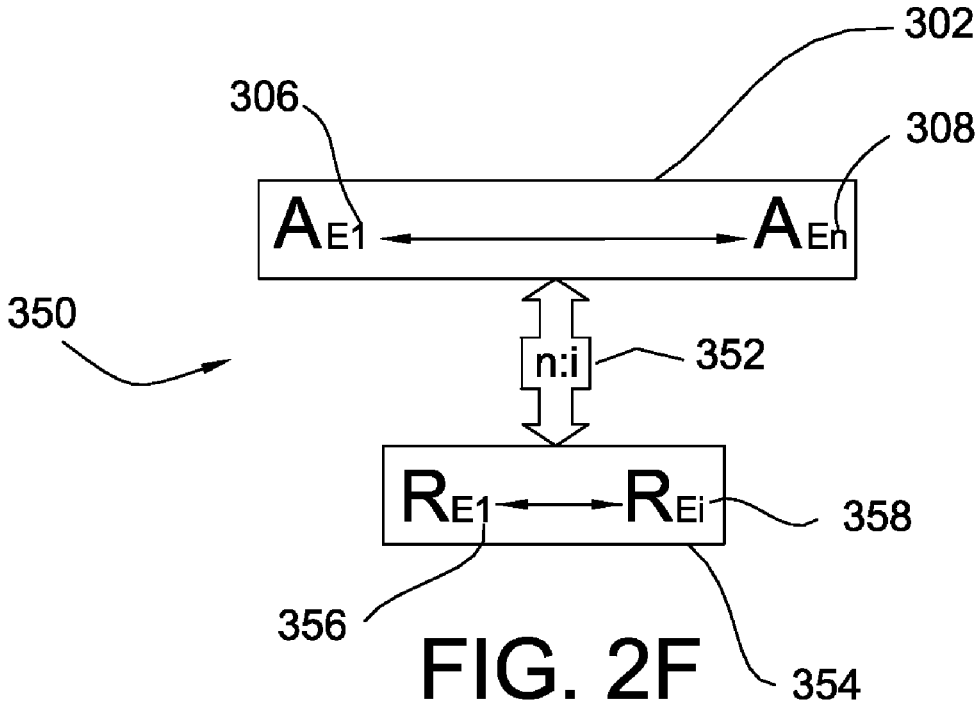
FIG. 2F is an alternative detail plan view of the combat correlation table.

At the end of the spectrum, and referring to FIG. 2D, a combative correlation table matrix 330 with an (n):(1) relation is provided. Here the attack element range 302 has a series of attack elements starting with a first attack element 306 and ending in a last attack elements 308 in the nth position. As a side note, the nth position will in most cases be 13 cards in a suit, or four suits if suits are played.

The single removable element range 334 has a first removable element 336 which will be eliminated in the (n):(1) element relation 332 if any one of the attack elements within the attack element range 32 are played during the attack round 44 (as seen in FIG. 5).

As a middle ground and still discussing the larger attack element range 302 correlation to a smaller removable element range 354 (as seen in FIG. F2), a combative correlation table matrix with an (n):(i) relation 350 is provided. Here within the attack element range 302 as previously discussed, the first attack element 306 begins the series and the nth or last attack element 308 ends the series. A smaller spectrum of removable elements can be eliminated through the play of the attack elements within the attack element range as determined by the (n):(1) element relation correlation 352. The removable element range 354 begins with a first removable element 356 and ends the series at a last removable element 358 in an ith position. The (i)th position as previously discussed is a lesser number than the (n)th position. For example, the attack element range 302 may have 13 cards in its range. The removable element range may have seven card elements within its range. In such a correlation, for example the number two and number three card elements may both eliminate the King removable element within the removable element range.

Additional variations of the combative correlation table matrix (as seen in FIGS. 2B through 2F are conceived.

Figure 8:
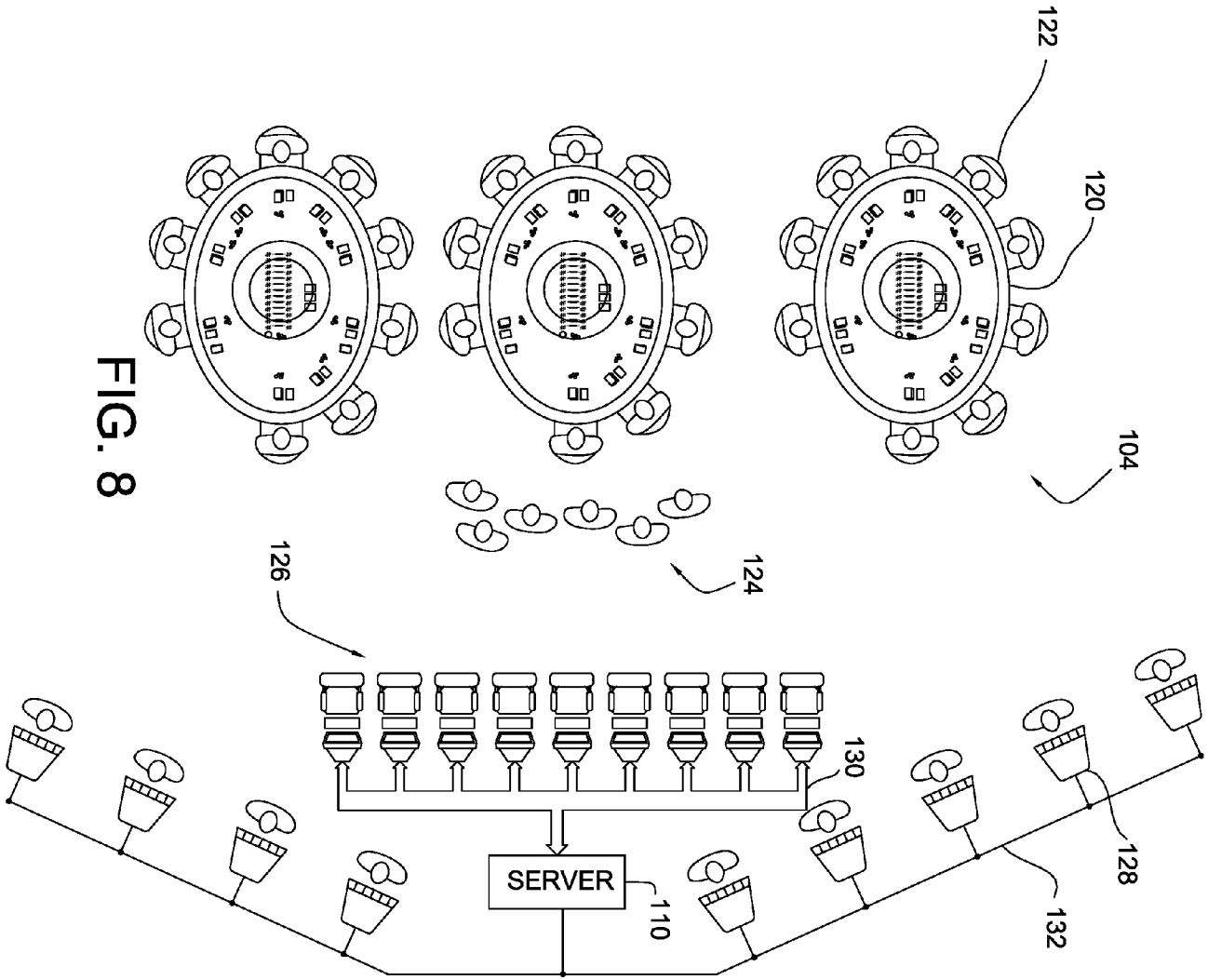
FIG. 8 is a plan view of a tournament casino environment.
Figure 9:
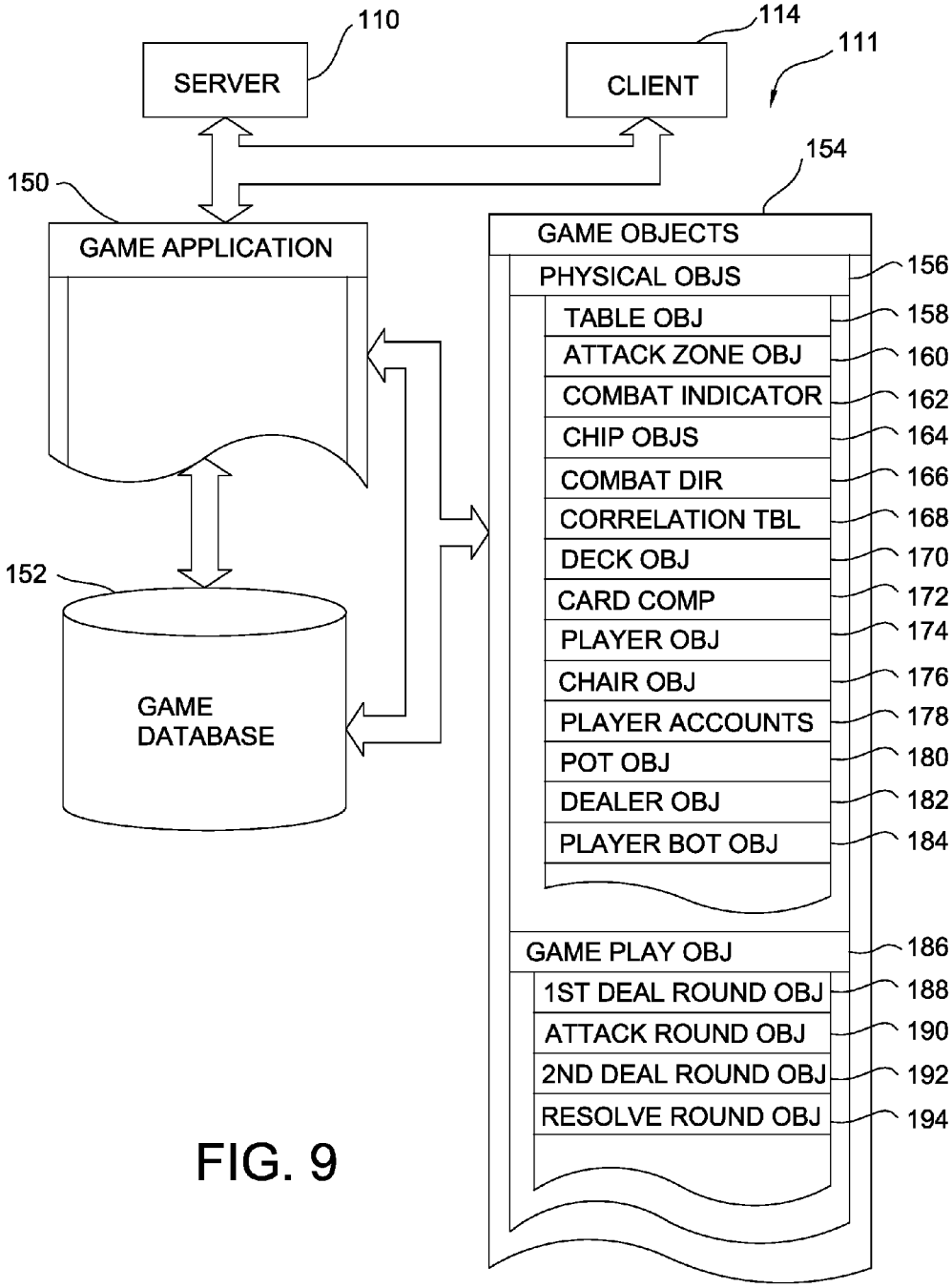
FIG. 9 is a schematic diagram of the combative poker game system architecture.

In order to implement the game play, the combative poker game 10 can be played either in the physical environment about a poker table 14 (as seen in FIG. 1) as well as within a tournament casino environment 104 (as seen in FIG. 8). It can also be played as a software application or game application 150 (as seen in FIG. 9) which can easily be hosted on a server 110 or played locally on a client 114. Other variations of the implementation of the game play such as a mix between software and hardware which may be implemented in say for example player vs. House games such as slot machines and the like 128 (as seen in FIG. 8) and game stations 126 (as seen in FIG. 8) can be implemented.

First, discussion of the implementation of the combative poker game 10 will be provided (as seen in FIG. 1) in the physical environment. Here for example, the combative poker game 10 has four players sitting in player chairs 16 around a circular table 14. An oval, square, or rectilinear table can be provided based on the number of players as well as the standard table design. A combat correlation table matrix 12 is imprinted on the top felt of the poker table 14. A standard 52 card playing deck 22 is used and the dealer position rotates after each game. The dealer shuffles the deck and each player receives three cards 18 face down. These are the player hand cards 18. One of these cards is played as the attack card 20 and the attack card is moved into the attack zone 26 during the attack round 44 (FIG. 5). As previously discussed, attack cards 20 eliminate cards on the table and in all players hands according to the combat correlation table matrix 12.

After the players perform their betting round, the dealer deals three common cards 24 which are placed in the common zone 25. Another round of betting (as seen in step 56, FIG. 4) occurs using the chips 28. The game play then moves into the attack round 44 (as seen in FIG. 5) where the players choose their attack cards in deal order and place them in the attack zone 26 position in a sideways direction. After all attack cards have been played, the attack card for each player is turned over to reveal which common cards 24 and player hand cards 18 will be eliminated as removable card elements 32 (as seen in FIG. 2).

As previously mentioned, the dealer will choose optionally which suit or element range will act as the attack card elements by indicating the puck location 34 in relation to the various element ranges.

As an option or alternative embodiment to the combative correlation table matrix 12 being resident on the table 14, the cards within the deck 22 can have resident on their face, the removable card elements 32 which can be eliminated by that particular playing card when the card is used as an attack card. For example, on a number "two" card, there would be a symbol of the letter "A" with a red circle and a diagonal line through the "A" indicating that the "two" card will eliminate Aces.

With regard to scoring rules, at the end of the game during the showdown phase, players may have utilized an attack card element and also may have in hand a removable card element, eliminated from another player's attack card element, leaving them with less than five cards. In such a situation, it is still possible to have the showdown phase where neither player has a full hand of five cards. For instance, one player may have an AJ44, while the other player has AJ433. In this example, the pair of 4s would win the hand despite the fact that the player does not have a "full" hand of 5 playable cards due to elimination. Note that it is not possible to get flushes, straights, or a full house with a playable hand of less than 5 cards. A hand with only 4 playable cards of which all are diamonds would not count as a flush.

In the above example where players have less than five cards, a sequence is provided for determining the winner of the high card hands. In his sequence, the top playable card of each hand is compared. The comparison is not the time, player having the higher card winds hand. For example, playable hand consisting of A43 would win against a playable hand of KQ43. If the top card comparison is a tie, repeat the comparison for the next highest cards in each hand. If all comparable cards are ties and one player has a longer length, that player wins the hand. For example, in a hand where one player has AK8 and the other player in the showdown has AK84, the AK84 player wins the hand. If both playable hands are equivalent, the hand is a tie. IE K64 versus K64.

Figure 7:
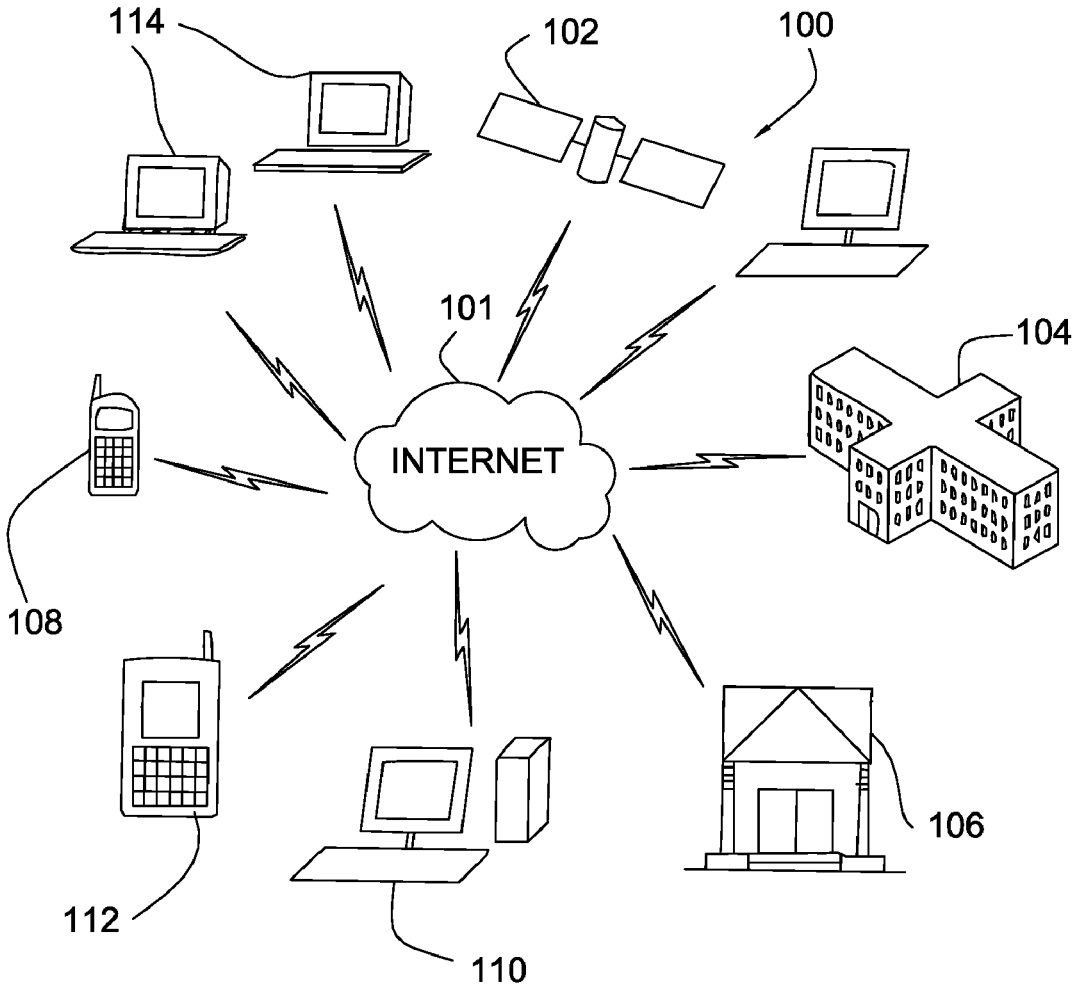
FIG. 7 is an environmental view of the poker game system.

While the above combative poker game 10 can be played in the physical table environment 14, it can also be implemented over a poker game system 100 (as seen in FIG. 7). Here the poker game system 100 is implemented through the use of the Internet 101 where the game application 150 (as seen in FIG. 9) is hosted on the server 110 (as seen in both FIGS. 7 and 9). To connect to the game application 150, one embodiment enables various client applications to run resident poker game applications 150 and play in a networked environment. This can be accomplished through the use of wireless communications connecting to the Internet 101 or other types of land-line communications such as a local area cable network, and the like. PDAs 112, cell phones 108, client computers 114, and casinos 104 can access the game server 110 in various means through the Internet 101.

In order to implement the poker game system 100, one embodiment of the game application 150 utilizes a game database 152 which holds the game objects 154. The game objects are initialized and run on the game application 150 depending on the game play and the type of game being played. Various game objects 154 are held within the game database 152. They include physical objects 156 such as table objects 158, attack zone objects 160, combat indicators 162, chip objects 164, combat direction 166, combat correlation tables 168, deck objects 170, card components 172, player objects 174, chair objects 176, player accounts 178, a pots object 180, a dealer object 182, and a player BOT object 184. Various game play objects 186 are also initialized in the game application 150 depending on the sequence. These game objects 186 correlate to the previously-mentioned game play in FIGS. 3-6. They include a first deal round object 188 which corresponds to the first step in the game play at first deal round 42 (as seen in FIG. 3). An attack round object 190 (as seen in FIG. 9) correlates to the attack round step 44 (as seen in FIG.

3). A second deal round object 192 correlates to the second deal round 46 (as seen in FIG. 3). The resolve round object 194 resolves the hands, as seen in the resolve round step 48 (as seen in FIG. 3).

As previously-mentioned, the game application 150 can be run say for example within a tournament casino environment 104. Here we see both the physical embodiment of the combative poker game 10 as being played on various casino game tables 120 by the player's 122. Additionally, the digital or software game application 150 is played in various formats either on the game stations 126 or on the player vs. the House games 128 connected either through the landline connection 132 or through a wireless type of router scenario 130 connecting directly to the server 110.

I claim:

1. A card elimination system for use in a poker game said system comprising:

a. a card elimination table for use in said poker game; said poker game comprising a plurality of players, a deck of cards comprising 52 card elements; said poker game further comprising: a betting round, an attack round; said poker game configured to provide each of said plurality of players at least two card elements, one of said at least two card elements comprising an attack card element;

b. said card elimination table comprising: a range of attack elements configured to operably eliminate one or more removable elements from a range of removable elements during said attack round;

c. said attack round configured to match an attack component located on said attack card element to a first attack element of said range of attack elements, match said first attack element to a second range of removable elements within said range of removable elements, and eliminate one or more removable card elements from said deck of cards or said at least two card hand from each of said plurality of players, resulting in a reduced deck of cards comprising less than 52 card elements.

2. The system according to claim 1 wherein said system further comprises said range of attack elements correlated to said range of removable elements through a series of predetermined attack direction elements.

3. The system according to claim 1 wherein said card element originates from a player component.

4. The system according to claim 3 wherein said player component comprises a person.

5. The system according to claim 3 wherein said player component comprises a player object resident in a database, said player object initialized in an application.

6. The system according to claim 1 wherein said card element originates from a dealer component.

7. The system according to claim 6 wherein said dealer component comprises a person.

8. The system according to claim 6 wherein said dealer component comprises a dealer object resident in a database, said dealer object initialized in an application.

9. The system according to claim 1 wherein said card elimination table further comprises said range of attack elements in 1:1 relation with said range of removable elements.

10. The system according to claim 1 wherein said card elimination table further comprises said range of attack elements in a 1:n relation with said range of removable elements.

11. The system according to claim 10 wherein said range of attack elements in a 1:n relation with said range of removable elements further comprises: a single attack element configured to eliminate more than one removable elements.

12. The system according to claim 1 wherein said card elimination table further comprises said range of attack elements in an n:1 relation with said range of removable elements.

13. The system according to claim 12 wherein said range of attack elements in an n:1 relation with said range of removable elements further comprises: more than one attack elements are configured to eliminate a single removable element.

14. The system according to claim 1 wherein said card elimination table further comprises said range of attack elements are in an i:n relation with said range of removable elements.

15. The system according to claim 14 wherein said range of attack elements in an i:n relation with said range of removable elements further comprises: a lesser number of attack elements configured to eliminate a greater number of removable elements.

16. The system according to claim 1 wherein said card elimination table further comprises said range of attack elements are in an n:i relation with said range of removable elements.

17. The system according to claim 16 wherein said range of attack elements in an n:i relation with said range of removable elements further comprises: a greater number of attack elements configured to eliminate a lesser number of removable elements.

18. The system according to claim 1 wherein said range of attack elements comprise the following card elements in a suit: aces, kings, queens, jacks, tens, nines, eights, sevens, sixes, fives, fours, threes, twos.

19. The system according to claim 1 wherein said range of attack elements comprise the following card elements in a suit: twos, threes, fours, fives, sixes, sevens, eights, nines, tens, jacks, queens, kings, aces.

20. The system according to claim 1 wherein said card elimination table comprises:

| | | |
|---|---|---|
| aces attack card elements | eliminate all | twos removable card elements; |
| kings attack card elements | eliminate all | threes removable card elements; |
| queens attack card elements | eliminate all | fours removable card elements; |
| jacks attack card elements | eliminate all | fives removable card elements; |
| tens attack card elements | eliminate all | sixs removable card elements; |
| nines attack card elements | eliminate all | sevens removable card elements; |
| eights attack card elements | eliminate all | eights removable card elements; |
| sevens attack card elements | eliminate all | nines removable card elements |
| sixs attack card elements | eliminate all | tens removable card elements; |
| fives attack card elements | eliminate all | jacks removable card elements; |
| fours attack card elements | eliminate all | queens removable card elements; |
| threes attack card elements | eliminate all | kings removable card elements; and, |
| twos attack card elements | eliminate all | aces removable card elements. |

21. The system according to claim 1 wherein said card elimination table comprises:

| | | |
|---|---|---|
| aces attack card elements | eliminate all | kings removable card elements; |
| kings attack card elements | eliminate all | queens removable card elements; |
| queens attack card elements | eliminate all | jacks removable card elements; |
| jacks attack card elements | eliminate all | tens removable card elements; |
| tens attack card elements | eliminate all | nines removable card elements; |
| nines attack card elements | eliminate all | eights removable card elements; |
| eights attack card elements | eliminate all | sevens removable card elements; |
| sevens attack card elements | eliminate all | sixes removable card elements |
| sixs attack card elements | eliminate all | fives removable card elements; |
| fives attack card elements | eliminate all | fours removable card elements; |
| fours attack card elements | eliminate all | threes removable card elements; |
| threes attack card elements | eliminate all | twos removable card elements; and, |
| twos attack card elements | eliminate all | aces removable card elements. |

22. The system according to claim 1 wherein said card elimination table further comprises said series of attack elements comprising a predetermined arrangement of playing card values from a standard card deck.

23. The system according to claim 1 wherein said series of removable elements further comprises a predetermined arrangement of playing card values from a standard card deck.

24. The system according to claim 1 wherein said card elimination table is resident on a poker table.

25. The system according to claim 1 wherein said card elimination table is resident on a board game.

26. The system according to claim 1 wherein said card elimination table is resident in a database.

27. The system according to claim 1 wherein said card elimination table is resident in a software application.

28. The system according to claim 1 wherein said card elimination table is resident on a standard deck of playing cards.

29. A system for playing poker, said system comprising:

a. a plurality of player elements participating in a poker game, said poker game comprising at least one deal round, a betting round and an attack round; said poker game configured to provide each of said plurality of player elements a deck component and an initial set of card elements to each of said player elements;

b. said initial set of card elements comprising two player hand card elements one of said player hand card elements operable as a player attack card element;

c. during said attack round said player elements utilizing a card elimination table configured to remove card elements from play and from said deck component, said card elimination table comprising: a range of attack elements and a range of removable elements, said range of attack elements correlated to said range of removable elements;

d. said range of attack elements configured to eliminate said correlated range of removable elements;

e. said attack round configured to match an attack component located on said player attack card element to a first attack element of said range of attack elements, match said first attack element to at least one removable element from said range of removable elements, and eliminate from play one or more removable card elements from said deck component resulting in a reduced deck component comprising a reduced set of card elements.

30. The system according to claim 29 wherein said plurality of player elements comprise people.

31. The system according to claim 29 wherein said plurality of player elements comprise a plurality of player objects resident in a database, said player objects initialized in a software application.

32. The system according to claim 29 wherein said dealer element comprises a person.

33. The system according to claim 29 wherein said dealer element comprises a dealer object resident in a database, said dealer object initialized in a software application.

34. The system according to claim 29 wherein said card elimination table further comprises said range of attack elements in 1:1 relation with said range of removable elements.

35. The system according to claim 29 wherein said card elimination table further comprises said range of attack elements in a 1:n relation with said range of removable elements.

36. The system according to claim 35 wherein said range of attack elements in a 1:n relation with said range of removable elements further comprises: a single attack element configured to eliminate more than one removable elements.

37. The system according to claim 29 wherein said card elimination table further comprises said range of attack elements in an n:1 relation with said range of removable elements.

38. The system according to claim 37 wherein said range of attack elements in an n:1 relation with said range of removable elements further comprises: more than one attack elements configured to eliminate a single removable element.

39. The system according to claim 29 wherein said card elimination table further comprises said range of attack elements in an i:n relation with said range of removable elements.

40. The system according to claim 39 wherein said range of attack elements in an i:n relation with said range of removable elements further comprises: a lesser number of attack elements configured to eliminate a greater number of removable elements.

41. The system according to claim 29 wherein said card elimination table further comprises said range of attack elements in an n:i relation with said range of removable elements.

42. The system according to claim 41 wherein said range of attack elements in an n:i relation with said range of removable elements further comprises: a greater number of attack elements configured to eliminate a lesser number of removable elements.

43. The system according to claim 29 wherein said range of attack elements comprise the following card elements in a suit: aces, kings, queens, jacks, tens, nines, eights, sevens, sixes, fives, fours, threes, twos.

44. The system according to claim 29 wherein said range of attack elements comprise the following card elements in a suit: twos, threes, fours, fives, sixes, sevens, eights, nines, tens, jacks, queens, kings, aces.

45. The system according to claim 29 wherein said card elimination table comprises:

| | | |
|---|---|---|
| aces attack card elements | eliminate all | twos removable card elements; |
| kings attack card elements | eliminate all | threes removable card elements; |
| queens attack card elements | eliminate all | fours removable card elements; |
| jacks attack card elements | eliminate all | fives removable card elements; |
| tens attack card elements | eliminate all | sixs removable card elements; |
| nines attack card elements | eliminate all | sevens removable card elements; |
| eights attack card elements | eliminate all | eights removable card elements; |
| sevens attack card elements | eliminate all | nines removable card elements |
| sixs attack card elements | eliminate all | tens removable card elements; |
| fives attack card elements | eliminate all | jacks removable card elements; |
| fours attack card elements | eliminate all | queens removable card elements; |
| threes attack card elements | eliminate all | kings removable card elements; and, |
| twos attack card elements | eliminate all | aces removable card elements. |

46. The system according to claim 29 wherein said card elimination table comprises:

| | | |
|---|---|---|
| aces attack card elements | eliminate all | kings removable card elements; |
| kings attack card elements | eliminate all | queens removable card elements; |
| queens attack card elements | eliminate all | jacks removable card elements; |

-continued

| | | |
|---|---|---|
| jacks attack card elements | eliminate all | tens removable card elements; |
| tens attack card elements | eliminate all | nines removable card elements; |
| nines attack card elements | eliminate all | eights removable card elements; |
| eights attack card elements | eliminate all | sevens removable card elements; |
| sevens attack card elements | eliminate all | sixes removable card elements |
| sixs attack card elements | eliminate all | fives removable card elements; |
| fives attack card elements | eliminate all | fours removable card elements; |
| fours attack card elements | eliminate all | threes removable card elements; |
| threes attack card elements | eliminate all | twos removable card elements; and, |
| twos attack card elements | eliminate all | aces removable card elements. |

47. The system according to claim 29 wherein said card elimination table further comprises said series of attack elements comprising a predetermined arrangement of playing card values from a standard card deck.

48. The system according to claim 29 wherein said series of removable elements further comprises a predetermined arrangement of playing card values from a standard card deck.

49. The system according to claim 29 wherein said card elimination table is resident on a poker table.

50. The system according to claim 29 wherein said card elimination table is resident on a board game.

51. The system according to claim 29 wherein said card elimination table is resident in a database.

52. The system according to claim 29 wherein said card elimination table is resident in an application.

53. The system according to claim 29 wherein said card elimination table is resident on a standard deck of playing cards.

* * * * *